US007591040B2

(12) United States Patent
Jou-Chen et al.

(10) Patent No.: US 7,591,040 B2
(45) Date of Patent: Sep. 22, 2009

(54) CLEANING TOOL FOR REMOVING LARGER AND SMALLER SIZED PARTICLES

(75) Inventors: Fung Jou-Chen, Appleton, WI (US); Jeffrey D. Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 229 days.

(21) Appl. No.: 10/739,530

(22) Filed: Dec. 18, 2003

(65) Prior Publication Data

US 2005/0132518 A1 Jun. 23, 2005

(51) Int. Cl.
*A47L 13/12* (2006.01)

(52) U.S. Cl. ..... 15/115; 15/118; 15/210.1; 15/160; 15/209.1; 15/228

(58) Field of Classification Search ..... 15/114, 15/118, 115, 160, 210.1, 209.1, 228
See application file for complete search history.

(56) References Cited

U.S. PATENT DOCUMENTS

| | | | | |
|---|---|---|---|---|
| 2,029,951 | A | | 2/1936 | Smith |
| 3,134,152 | A | | 5/1964 | Pei |
| 3,537,123 | A | | 11/1970 | Leland |
| 3,656,202 | A | * | 4/1972 | Paton ..... 15/121 |
| 3,857,133 | A | | 12/1974 | Linenfelser |
| 3,886,617 | A | | 6/1975 | Labran et al. |
| 4,018,575 | A | | 4/1977 | Davis et al. |
| 4,188,447 | A | | 2/1980 | Ehlenz |
| 4,225,997 | A | | 10/1980 | Thomas et al. |
| 4,254,527 | A | | 3/1981 | Pfeifer |
| 4,517,703 | A | | 5/1985 | Koke |
| 4,523,347 | A | | 6/1985 | Tames |
| 4,807,725 | A | | 2/1989 | Weiler et al. |
| 4,852,210 | A | | 8/1989 | Krajicek |
| 4,870,725 | A | | 10/1989 | Dubowik |
| 5,094,559 | A | | 3/1992 | Rivera et al. |
| 5,249,325 | A | * | 10/1993 | Wilen ..... 15/4 |
| 5,401,446 | A | | 3/1995 | Tsai et al. |

(Continued)

FOREIGN PATENT DOCUMENTS

| | | |
|---|---|---|
| CH | 360592 | 2/1962 |

(Continued)

OTHER PUBLICATIONS

Chen et al., U.S. Appl. No. 10/884,748, filed Jul. 2, 2004, Cleaning Product for Storing and Attaching Cleaning Blocks or Wipes.

(Continued)

*Primary Examiner*—Shay L Karls
(74) *Attorney, Agent, or Firm*—Dority & Manning, P.A.

(57) ABSTRACT

A cleaning tool, which in some instances may be a mop, for use in cleaning a surface is provided. The cleaning tool includes a frame and a primary cleaning member that is carried by the frame. The primary cleaning member is configured for removing generally smaller size particles from the surface that is cleaned. A secondary cleaning member is included and is also carried by the frame. The secondary cleaning member is configured for removing generally larger size particles from the surface to be cleaned.

36 Claims, 6 Drawing Sheets

U.S. PATENT DOCUMENTS

| | | | | |
|---|---|---|---|---|
| 5,419,015 | A | 5/1995 | Garcia | |
| 5,488,750 | A * | 2/1996 | Vosbikian et al. | 15/119.2 |
| 5,600,865 | A | 2/1997 | Morrison | |
| 5,624,427 | A | 4/1997 | Bergman et al. | |
| D417,934 | S | 12/1999 | Footer et al. | |
| 6,021,542 | A | 2/2000 | Norman | |
| 6,112,362 | A | 9/2000 | Parko et al. | |
| 6,197,928 | B1 | 3/2001 | Tsien et al. | |
| 6,211,128 | B1 | 4/2001 | Black | |
| 6,245,413 | B1 * | 6/2001 | Kenmochi et al. | 428/157 |
| 6,336,240 | B1 | 1/2002 | Laux et al. | |
| 6,365,088 | B1 | 4/2002 | Knight et al. | |
| 6,416,959 | B1 | 7/2002 | Giuliano et al. | |
| 6,433,244 | B1 | 8/2002 | Roe et al. | |
| 6,436,234 | B1 | 8/2002 | Chen et al. | |
| 6,487,746 | B1 | 12/2002 | Cioci | |
| 6,501,002 | B1 | 12/2002 | Roe et al. | |
| 6,503,615 | B1 | 1/2003 | Horii et al. | |
| 6,544,245 | B2 | 4/2003 | Neeb et al. | |
| 6,561,354 | B1 | 5/2003 | Fereshtehkhou et al. | |
| 6,586,483 | B2 | 7/2003 | Kolb et al. | |
| 6,608,118 | B2 | 8/2003 | Kosaka et al. | |
| 6,617,490 | B1 | 9/2003 | Chen et al. | |
| 2003/0044569 | A1 | 3/2003 | Kacher et al. | |
| 2003/0074756 | A1 | 4/2003 | Policicchio et al. | |
| 2003/0135181 | A1 * | 7/2003 | Chen et al. | 604/374 |
| 2003/0164175 | A1 | 9/2003 | Linzell | |
| 2004/0045112 | A1 | 3/2004 | Naumann | |
| 2004/0086320 | A1 | 5/2004 | Policicchio et al. | |
| 2004/0111817 | A1 | 6/2004 | Chen et al. | |
| 2004/0115431 | A1 | 6/2004 | Chen et al. | |
| 2006/0137119 | A1 * | 6/2006 | Otsuka et al. | 15/104.002 |

FOREIGN PATENT DOCUMENTS

| | | | |
|---|---|---|---|
| DE | 2643717 | | 8/1977 |
| DE | 8511694 | | 11/1994 |
| DE | 29813214 | U1 | 10/1998 |
| EP | 0011055 | | 5/1980 |
| EP | 0370697 | | 5/1990 |
| EP | 0856276 | | 8/1998 |
| EP | 1147734 | A2 | 10/2001 |
| EP | 0986322 | B1 | 12/2001 |
| EP | 1209167 | A1 | 5/2002 |
| EP | 1314390 | A1 | 5/2003 |
| EP | 0983014 | B1 | 12/2003 |
| FR | 1195436 | | 11/1959 |
| FR | 2840523 | | 12/2003 |
| GB | 664694 | | 1/1952 |
| GB | 1131846 | | 10/1968 |
| GB | 1354576 | | 6/1974 |
| GB | 2125689 | | 3/1984 |
| JP | 09164110 | | 6/1997 |
| JP | 11137503 | | 5/1999 |
| WO | WO 9842819 | | 1/1998 |
| WO | WO 9852458 | | 11/1998 |
| WO | WO 9852459 | | 11/1998 |
| WO | WO 0000148 | | 1/2000 |
| WO | WO 0027271 | | 5/2000 |
| WO | WO 0111004 | | 2/2001 |
| WO | WO 0112526 | | 2/2001 |
| WO | WO 0141622 | | 6/2001 |
| WO | WO 0149776 | | 7/2001 |
| WO | WO 0154552 | | 8/2001 |
| WO | WO 0162132 | | 8/2001 |
| WO | WO 0200088 | | 1/2002 |
| WO | WO 0212855 | | 2/2002 |
| WO | WO 0241746 | A2 | 5/2002 |
| WO | WO 0241747 | | 5/2002 |
| WO | WO 0243555 | A1 | 6/2002 |
| WO | WO 02083834 | | 10/2002 |
| WO | WO 03000104 | | 1/2003 |
| WO | WO 03000105 | | 1/2003 |
| WO | WO 03001962 | | 1/2003 |
| WO | WO 03004748 | | 1/2003 |
| WO | WO 03024295 | | 3/2003 |
| WO | WO 03040312 | | 5/2003 |

OTHER PUBLICATIONS

Lindsay et al., U.S. Appl. No. 10/884,075, filed Jul. 2, 2004, Kits of Foam Based Cleaning Elements.
Search Report and Written Opinion for PCT/US2005/017398, Sep. 27, 2005.
Abstract of Japanese Patent No. JP2002059443, Feb. 26, 2002.
Abstract of Japanese Patent No. JP2003116762, Apr. 22, 2003.
"High-bulk Tissue Laminates for Building Materials and Other Purposes," by J.D. Lindsay, et al., published as Document 19880D at IP.com, Oct. 6, 2003.
Protein Eng. Jun. 2002, 15(6): 493-502.
U.S. Appl. No. 10/036,736, filed Dec. 21, 2001.
U.S. Appl. No. 10/277,170, filed Oct. 21, 2002.
U.S. Appl. No. 10/321,277, filed Dec. 17, 2002.
U.S. Appl. No. 10/733,162, filed Dec. 11, 2003.
U.S. Appl. No. 10/733,169, filed Dec. 11, 2003.
U.S. Appl. No. 10/743,556, filed Dec. 22, 2003.
U.S. Appl. No. 10/743,261, filed Dec. 22, 2003.
U.S. Appl. No. 10/744,238, filed Dec. 22, 2003.
PCT Search Report Nov. 17, 2004.
Written Opinion Nov. 17, 2004.
Kelly Autumn, et al., Evidence for vander Waals Adhesion in Gecko Setae, Proceedings of the National Academy of Science of the United states of America, vol. 99, No. 19; pp. 12,252-12,256 (Sep. 17, 2000).
Science, Jul. 11, 2003."A B Cell-Based Sensor For Rapid Identification of Pathogens." Rider, et al.
Article—*Sensors can detect deadly bio-weapons in seconds*—published by Detroit Free Press at http://www.freep.com, web.archive.org, July 11, 2003—Author; Paul Recer, Associated Press.
Article—*Rational design of green fluorescent protein mutants as biosensor for bacterial endotoxin*—published by PubMed at http://www.ncbi.nlm.nih.gov, Jun. 2002.—Authors; Goh YY, Frecer V, Ho B, Ding JL.
Chen et al., U.S. Appl. No. 11/942,801, filed Nov. 20, 2007, "Activatable Fastening System and Web Having Elevated Regions and Functional Material Members".

* cited by examiner

CLEANING TOOL FOR REMOVING LARGER AND SMALLER SIZED PARTICLES

BACKGROUND

Cleaning tools, such as mops, are commonly used in order to clean surfaces and other objects found in industry and in residential settings. Mops typically include an elongated handle with a mop head attached to the handle. A disposable wipe may be attached to the mop head, and may be configured in order to pick up dirt, lint, fluid, and other material from a surface when the mop head is moved over the surface.

A disposable wipe may be configured in order to pick up these materials when the disposable wipe is dry. Alternatively, the disposable wipe may be configured as a wet wipe in order to pick up these materials when the disposable wipe is moist to some degree. Once the disposable wipe reaches the end of its design life, the user may remove the disposable wipe from the mop head and subsequently throw away the disposable wipe. At such time, a new disposable wipe may be applied to the mop head in order to resume or start cleaning.

The bottom surface of the mop head is flat, causing the disposable wipe to be pressed flat against the surface to be cleaned. As such, the disposable wipe is moved as a substantially uniform object over the surface to be cleaned, which is also a substantially uniform surface. While smaller unwanted particles may be removed and retained, cleaning in this manner is ineffective at capturing and retaining larger particles, such as dust or lint, from the surface to be cleaned. For instance, balls of dust and/or lint may be shed from the disposable wipe either during cleaning, or after the mop head has been lifted up from the surface that was being cleaned.

The present invention provides for an improved cleaning tool and mop for use in cleaning a surface that is capable of removing both smaller and larger sized particles from the surface to be cleaned.

SUMMARY

Various features and advantages of the invention will be set forth in part in the following description, or may be obvious from the description.

The present invention provides for a cleaning tool, which in certain exemplary embodiments may be a mop, for use in cleaning a surface to be cleaned. The cleaning tool includes a frame and a primary cleaning member that is carried by the frame. The primary cleaning member is configured for removing generally smaller sized particles from the surface to be cleaned. A secondary cleaning member is included and is also carried by the frame. The secondary cleaning member is configured for removing generally larger sized particles. When configured as a mop, the primary and secondary cleaning members are carried by a mop head, which is attached to a handle that may be grasped by a user of the mop. The user may use the mop such that the primary cleaning member is moved across the surface to be cleaned and retains unwanted objects thereon. In such an instance, the secondary cleaning member will retain unwanted objects thereon that escaped retention by the primary cleaning member.

The present invention provides for exemplary embodiments of the cleaning tool as discussed above where the secondary cleaning member may be a plurality of hooks, a gecko-like fastener, and/or a brush that is configured for engaging and retaining the generally larger sized particles. The secondary cleaning member may be either attached to the primary cleaning member or separate therefrom.

Also, included in accordance with the present invention is a cleaning tool as set forth above where the primary cleaning member has a three-dimensional cleaning surface that defines at least one cavity. In accordance with various exemplary embodiments of the present invention, the secondary cleaning member may be attached to the primary cleaning member and located either in the cavity defined by the three-dimensional cleaning surface, outside of the cavity defined by the three-dimensional cleaning surface, or located both inside and outside of the cavity defined by the three-dimensional cleaning surface. Alternatively, the secondary cleaning member may be attached to the frame instead of to the primary cleaning member.

The present invention also provides for a cleaning tool where the primary cleaning member is a disposable sponge substitute that is made of laminated tissue layers. Alternatively, the primary cleaning member may be a nonwoven web in accordance with other exemplary embodiments.

Further included in accordance with the present invention is a cleaning tool as set forth above where the frame carries a biosensor that is configured for indicating the presence of a biological or chemical agent. The biosensor may indicate the presence of the biological or chemical agent by an optical signal.

When the cleaning tool of the present invention is configured as a mop, the primary cleaning member may be a disposable wipe that is attached to the upper surface of the mop head and covers the bottom surface of the mop head. Alternatively, the disposable wipe may be attached to the bottom surface of the mop head and may be free from contact with the top surface of the mop head. Also provided for in accordance with the present invention is an exemplary embodiment where the primary cleaning member is made of a plurality of laminated wet resilient tissue layers and has an outer layer that is made of a nonwoven material.

The present invention also provides for a mop as discussed above where the primary cleaning member is made of a plurality of laminated wet resilient tissue layers contained in a nonwoven envelope. A plurality of hooks are located in a cavity that is defined by the primary cleaning member. The plurality of hooks are configured for retaining unwanted objects thereon that escaped retention by the primary cleaning member.

DETAILED DESCRIPTION

Figure 1:
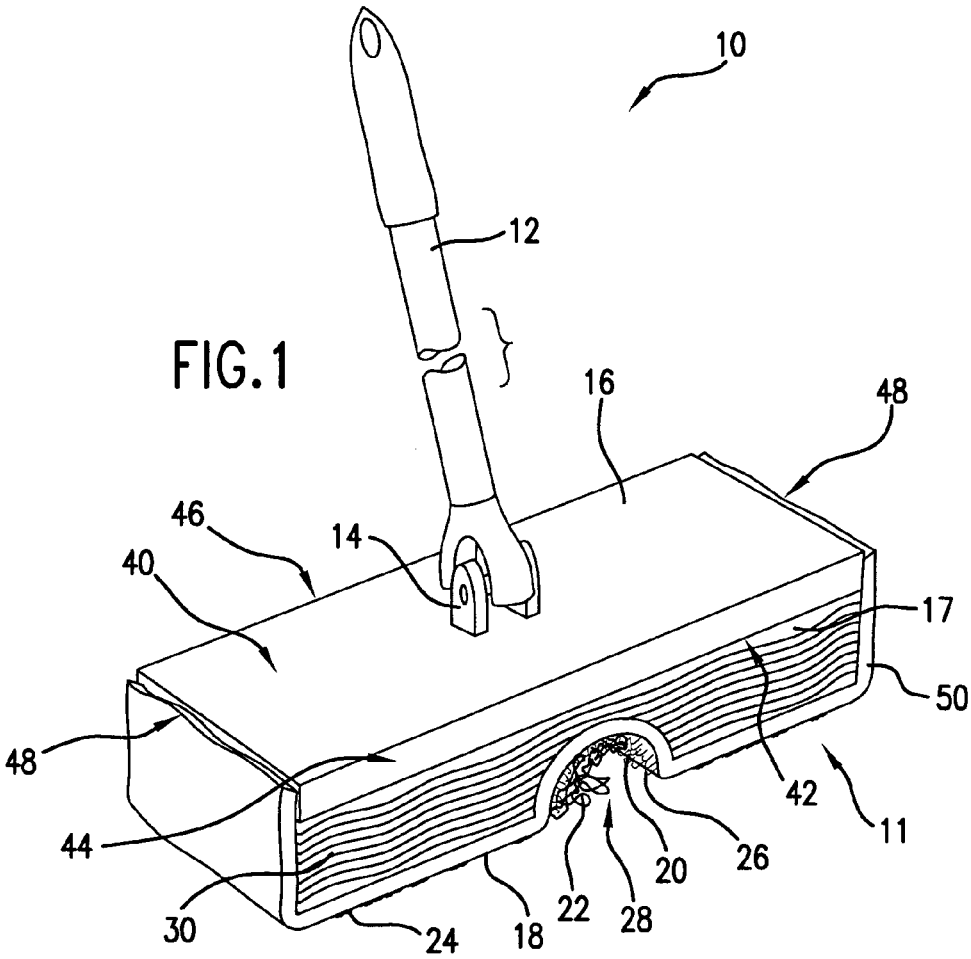
FIG. 1 is a perspective view of a mop in accordance with one exemplary embodiment of the present invention. The mop has a mop head including a plurality of laminated tissues layers and a cavity in which a plurality of hooks are located.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It should be understood that the ranges and limits mentioned herein include all ranges located within, and also all values located under or above the prescribed limits. For instance, a range of from 100 to 200 also includes ranges from 100 to 150, 70 to 90, and 53 to 62. Further, a limit of up to about 7 also includes a limit of up to about 5, up to about 3, and up to about 4.5.

The present invention provides for a cleaning tool 10, which may be a mop or a hand wipe, that includes both a primary cleaning member 18 and a secondary cleaning member 20. The primary cleaning member 18 is configured for removing generally smaller sized particles from a surface to be cleaned, while the secondary cleaning member is configured for removing generally larger sized particles from the surface to be cleaned.

An exemplary embodiment of the cleaning tool 10 is shown FIG. 1. Here, the cleaning tool 10 is a mop 11 which may be used by a user in order to clean a floor or other surface. The mop 11 includes a handle 12 that may be grasped by a user in order to move the mop 11 across the surface to be cleaned. The mop 11 includes a frame 17 that is a mop head 16. The handle 12 may be pivotally attached to the mop head 16 by a hinge 14. The hinge 14 may be configured in a manner similar to the universal joint disclosed in U.S. Pat. No. 4,852,210, the entire disclosure of which is incorporated by reference herein in its entirety for all purposes. Alternatively, the handle 12 may be configured in order to remain stationary with respect to the mop head 16 in other exemplary embodiments.

The primary cleaning member 18 is a disposable sponge substitute made of a plurality of laminated tissue layers 30. Alternatively, the primary cleaning member 18 may comprise a regenerated cellulose sponge or other sponge material, coform material comprising cellulosic fibers and polymeric meltblown binding material, a molded airlaid web comprising cellulosic fibers and a binding agent, high-loft nonwoven webs and other nonwoven materials, and the like. The laminated tissue layers 30 allow for the flow of liquid therethrough, hence allowing the mop 11 to clean by wet cleaning. The primary cleaning member 18 may also include a nonwoven envelope 50 that covers the plurality of laminated tissue layers 30. The primary cleaning member 18 may be a foam or sponge material in accordance with other exemplary embodiments of the present invention. The primary cleaning member 18 is configured for removing generally smaller sized particles 24 from the surface to be cleaned, and retaining the generally smaller sized particles 24 thereon. The smaller sized particles 24 may be small pieces of dirt such as dust or lint. For example, the particles may be wet or dry and may have an effective diameter of about 500 microns or less, such as about 100 microns or less, or about 20 microns or less, or about 5 microns or less, including colloidal particles and materials in a slurry or dispersion.

Figure 2:
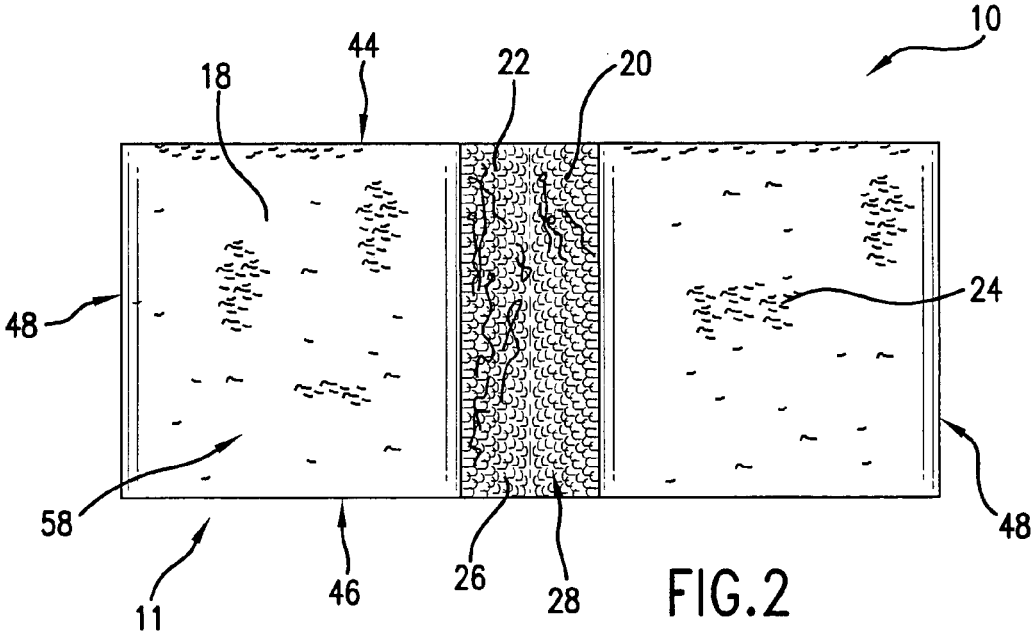
FIG. 2 is a bottom view of the mop of FIG. 1.

The primary cleaning member 18 defines a cavity 28. The cavity 28 may be defined in any manner commonly known to those skilled in the art. For instance, the laminated tissue layers 30 may be attached to one another such that each laminated tissue layer 30 is continuous above the cavity 28, but discontinuous and formed into two pieces at locations surrounding the cavity 28. Alternatively, the laminated tissue layers 30 may be attached to one another such that adhesion is used in the area proximate to the cavity 28 in order to shape the laminated tissue layers 30 to define the cavity 28. The laminated tissue layers 30 or other absorbent material may be molded into a three-dimensional shape to define the cavity 28. Molding of materials that have thermoplastic binder agents can be done with thermal techniques such as the use of heated molding plates or application of microwaves followed by pressure molding of the materials. Other methods and devices suitable for such molding operations are disclosed in U.S. Pat. No. 6,617,490, "Absorbent Articles with Molded Cellulosic Webs," issued Sep. 9, 2003 to Chen et al., and in "High-bulk Tissue Laminates for Building Materials and Other Purposes," by J. D. Lindsay et al., published as Document 19880D at IP.com, Oct. 6, 2003, both of which are herein incorporated by reference. Alternatively, a separate rigid component (not shown) may be incorporated into the primary cleaning member 18 in order to define the cavity 28. Although shown as extending from one side of the mop head 16 to the other side of the mop head 16, as can be seen for instance in FIG. 2, the cavity 28 may be configured in order to only extend partially across the mop head 16 in accordance with other exemplary embodiments.

The secondary cleaning member 20 is attached to the primary cleaning member 18. The secondary cleaning member 20 includes a plurality of hooks 26 that are disposed in the cavity 28 and are attached to the nonwoven envelope 50. The hooks 26 may be provided in any number and in any style as is commonly known to those skilled in the art. The hooks 26 may extend any height from the surface to which the hooks 26 are attached. For instance, the hooks 26 may extend about 0.1 millimeters, about 0.3 millimeters, about 0.5 millimeters, or about 0.7 millimeters from the primary cleaning member 18.

The hooks 26 are configured for removing and retaining generally larger sized particles 22 from the surface to be cleaned. The generally larger sized particles 22 are larger than the generally smaller sized particles 24 and typically may have a fibrous or entangled, bulky nature readily engaged by hooks 26. Alternatively, the generally larger sized particles 22 may be the same type of material as the generally smaller sized particles 24, but larger due to the fact that the particles are bunched together with one another or are otherwise combined into a larger object. The generally larger sized particles 22 may be, for instance, balls of dust, lint, or other unwanted materials. The generally larger sized particles 22 are thus able to be retained on the mop head 16 by a combination of the cavity 28 and the hooks 26. The cavity 28 allows for a space separate from a portion of the primary cleaning member 18 that engages the surface to be cleaned and retains the generally smaller sized particles 24.

In one embodiment, the primary cleaning member 18 may be substantially free of hooks 26. The surface of the primary cleaning member 18 may be substantially smooth or may have a texture, such as a repeating pattern of raised and depressed regions with a characteristic peak-to-valley height of about 2 millimeters or less, or about 1 millimeter or less, or about 0.5 millimeters or less.

Figure 3:
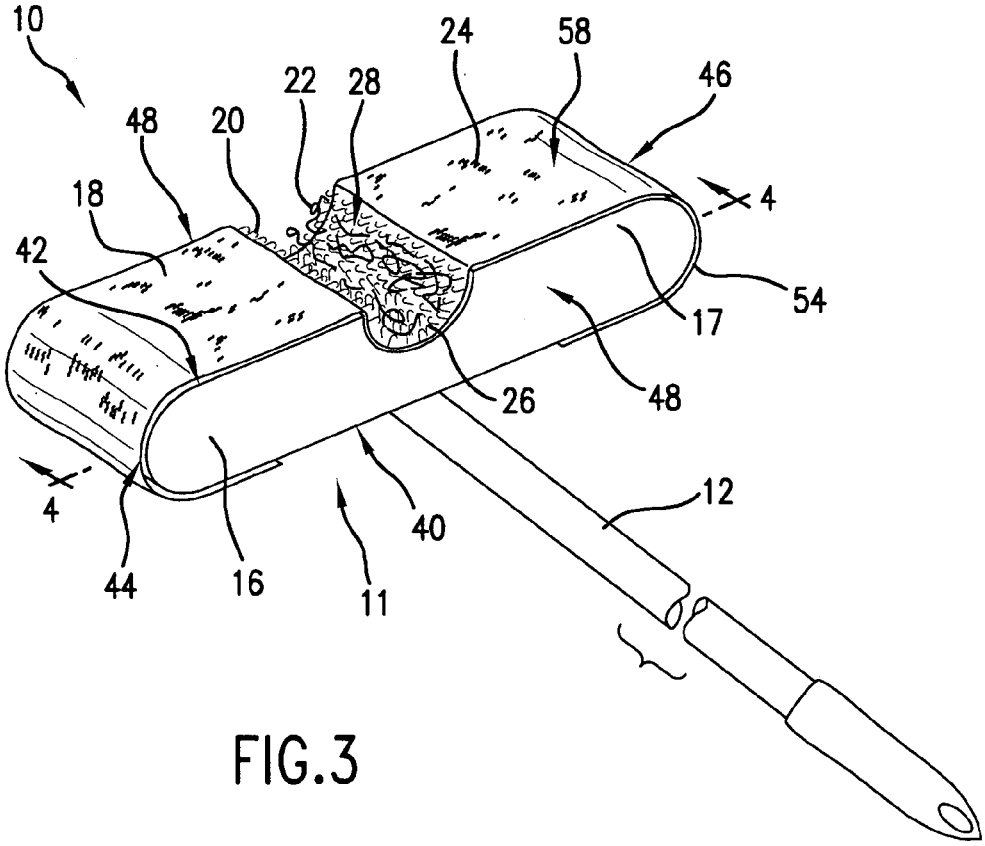
FIG. 3 is a perspective view of a mop in accordance with one exemplary embodiment of the present invention. A disposable wipe is attached to a mop head of a mop, and a plurality of hooks are located in a cavity of the mop head.
Figure 4:
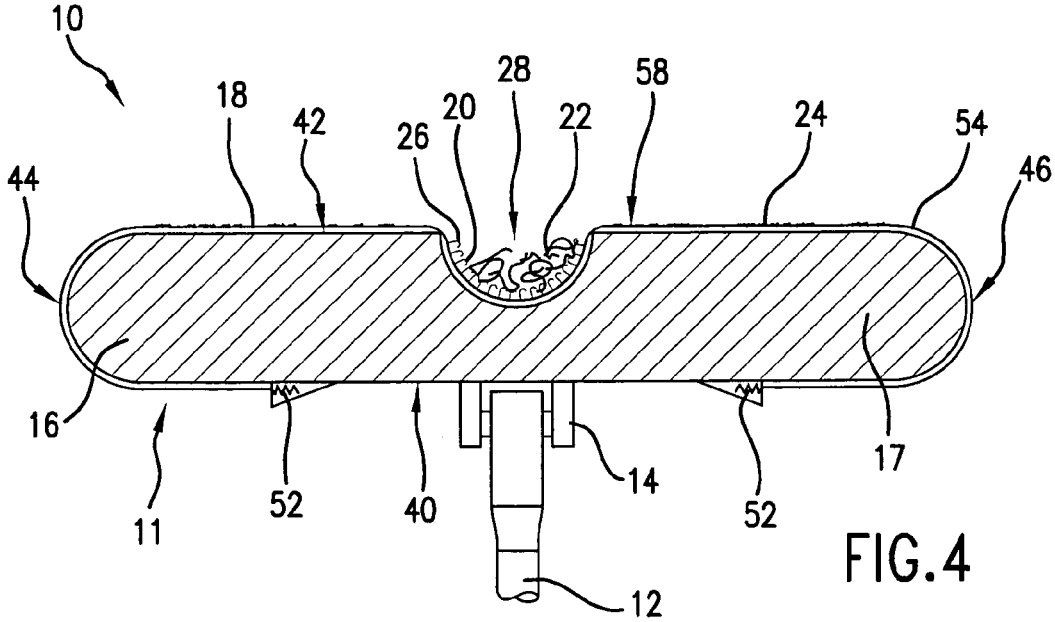
FIG. 4 is a cross-sectional view taken along line 4-4 of FIG. 3.

The primary and secondary cleaning members 18, 20 may be either permanently attached and/or carried by the mop head 16, or may be removably attached and/or carried by the mop head 16. FIGS. 3 and 4 show another exemplary embodiment of the mop 11. In this exemplary embodiment, the primary cleaning member 18 is a disposable wipe 54 that is wrapped around a bottom surface 42 of the mop head 16. The disposable wipe 54 is attached to an upper surface 40 of the mop head 16 by a pair of gripping elements 52. In this manner, the disposable wipe 54 also covers the leading edge 44 and trailing edge 46 of the mop head 16. Alternatively, the disposable wipe 54 may be configured in order to wrap around and cover the side edges 48 of the mop head 16. Although shown as being attached to the upper surface 40, it is to be understood that in accordance with other exemplary embodiments of the present invention that the disposable wipe 54 may be attached to and contact only the bottom surface 42 of the mop head 16.

The mop head 16 defines the cavity 28. The disposable wipe 54 may be wrapped around the mop head 16 such that the disposable wipe 54 is disposed in the cavity 28. The secondary cleaning member 20, in this instance a plurality of hooks 26, is attached to the disposable wipe 54 at a location such that the hooks 26 are located in the cavity 28 when the disposable wipe 54 is attached to the mop head 16. The mop 11 may be configured in order to clean in a dry state such that the mop head 16 is moved across a surface and the disposable wipe 54 retains generally smaller sized particles 24 thereon. The hooks 26 will act to capture and retain generally larger sized particles 22 that are not able to be retained by the disposable wipe 54. The generally larger sized particles 22 may be, for instance, balls of dust, fiber bundles, hair, and other materials that are larger than those retained by the disposable wipe 54.

The cavity 28 may be of any depth. For instance, the cavity 28 may be at least 0.3 millimeters in depth with respect to a main contacting surface 58 of the primary cleaning member 18. Further, the cavity 28 may be at least 0.5 millimeters, at least 1 millimeter, at least 2 millimeters, at least 3 millimeters, or at least 5 millimeters or greater in depth with respect to the main contacting surface 58 in accordance with other exemplary embodiments. If the portion of the cavity 28 or cavities 28 proximate to the main contacting surface 58 of the primary cleaning member 18 were included in the surface area of the main contacting surface 58, this area of the cavity 28 or cavities 28 may occupy less than 50% of the surface area of the main contacting surface 58. Alternatively, this area of the cavity 28 or cavities 28 may occupy less than 40%, less than 30%, or less than 20% of the surface area of the main contacting surface 58 of the primary cleaning member 18 in accordance with other exemplary embodiments. Still further, this area of the cavity 28 or cavities 28 may occupy any percentage of the surface area of the main contacting surface 58 in accordance with the present invention.

Although shown as extending from one side edge 48 to the other side edge 48, the cavity 28 need not extend fully from one side edge 48 to the other in accordance with other exemplary embodiments of the present invention. Further, the cavity 28 may extend in any direction in relation to the mop head 16. For instance, the cavity 28 may extend from the leading edge 44 to the trailing edge 46, from one side edge 48 to the other, or may extend at one or more angles to either of the edges 44, 46, or 48. For example, one or more cavities 18 may extend at an acute angle such as 450 relative to the front-to-back axis of the mop head 16. Further, there may be more than one cavity 28 employed in accordance with other exemplary embodiments of the present invention. As such, the present invention includes exemplary embodiments where any number of cavities 28 may be provided in any shape, orientation, size, location, or configuration.

Once the disposable wipe 54 has reached the end of its useful life, a user may disengage the disposable wipe 54 from the gripping elements 52 in order to remove the disposable wipe 54 from the mop head 16. At such time the disposable wipe 54 may be discarded, also causing the generally larger and smaller sized particles 22, 24 retained on the disposable wipe 54 and the hooks 26 to be discarded. A user may then attach a new disposable wipe 54 having a new set of hooks 26 onto the mop head 16 in order to start or resume cleaning of the surface.

Although shown as having gripping elements 52, the mop head 16 may be configured so that the disposable wipe 54 is attached thereto in accordance with any manner commonly known to those skilled in the art. For instance, the disposable wipe 54 may be attached to the mop head 16 through an adhesive. Alternatively, the disposable wipe 54 may be wrapped around the mop head 16 and attach thereto through the use of a hook and loop type fastener.

The disposable wipe 54 may be made of any material commonly known to those skilled in the art. For instance, the disposable wipe 54 may be a tissue layer joined to a coarse meltblown material such as the multifilamentary aggregate disclosed in U.S. patent application Ser. No. 10/321,277 filed on Dec. 17, 2002 entitled "Disposable Scrubbing Product". U.S. Patent application Ser. No. 10/321,277 is owned by the assignee of the present application and is incorporated by reference herein in its entirety for all purposes. The disposable wipe 54 may alternatively be a coarse nonwoven material in accordance with other exemplary embodiments of the present invention. Further, the disposable wipe 54 may be an uncreped through-air dried tissue which may be further joined with a nonwoven material such as a meltblown, spunbond, or scrim layer. Further, the disposable wipe 54 may be a hydroentangled or hydroneedled material in accordance with other exemplary embodiments of the present invention.

Further examples of the primary cleaning member 18, which for instance may be a disposable wipe 54 that may be used in accordance with certain exemplary embodiments of the present invention, may be found in U.S. Pat. No. 6,561,354 entitled "Package of Novel Three-Dimensional Structures Useful As Cleaning Sheets", which issued on May 13, 2003; and in U.S. Pat. No. 6,501,002 entitled "Disposable Surface Wipe Article Having A Waste Contamination Sensor" which issued on Dec. 31, 2002; and in U.S. Pat. No. 6,433,244 entitled "Disposable Treatment Article Having A Responsive System" which issued on Aug. 13, 2002. The entire contents of U.S. Pat. Nos. 6,561,354; 6,501,002; and 6,433,244 are incorporated by reference herein in their entirety for all purposes.

The disposable wipe 54 may be electrostatically charged either uniformly, or in a pattern, in order to assist in the capture and retention of the generally smaller size particles 24 thereon. Methods for providing electrostatic charge (e.g., electrets) in a nonwoven web are well known. Examples include U.S. Pat. No. 6,365,088, issued Apr. 2, 2003 to Knight et al., and in U.S. Pat. No. 5,401,446 issued Mar. 28, 1995 to Tsai et al, both of which are herein incorporated by reference.

Figure 5:
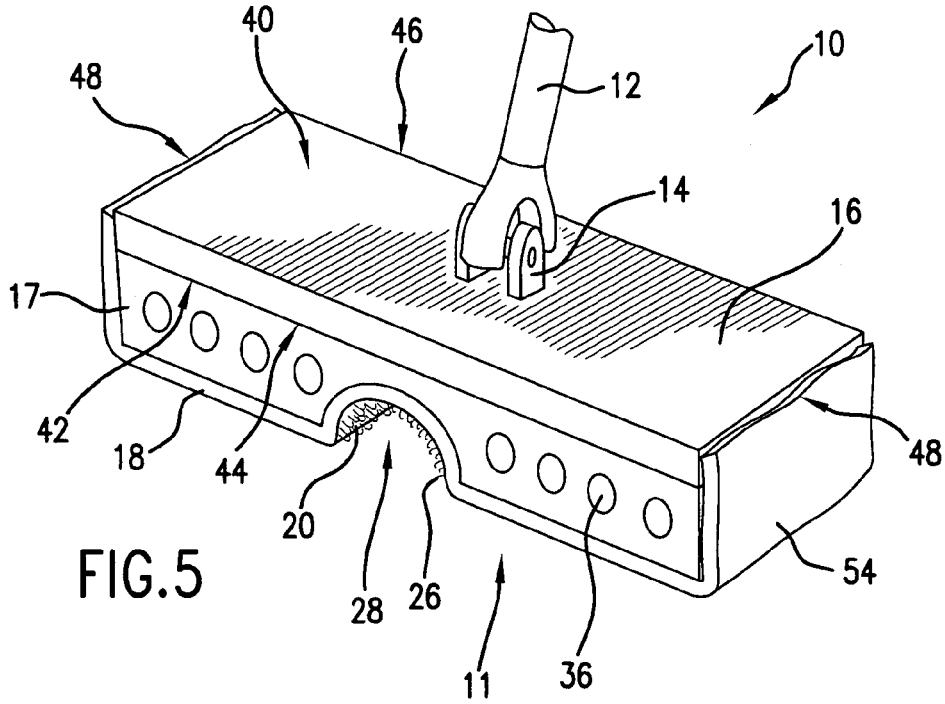
FIG. 5 is a perspective view of a mop in accordance with one exemplary embodiment of the present invention. The mop has a mop head that includes a plurality of functional members that may be either cleaning agents or biosensor agents.

Other features may be incorporated into the mop head 16 in accordance with other exemplary embodiments of the present invention. For instance, FIG. 5 shows the mop head having a plurality of functional members 36 disposed therein. The functional members 36 may be cleaning agents that are used in order to assist the primary cleaning member 18 in cleaning the surface. The functional members 36 may be a capsule that breaks upon compression or bending of the mop head 16, or alternatively may be a water soluble capsule which breaks when contacting water. A cleaning agent such as a powder or an aqueous solution may be released to aid in cleaning the surface to be cleaned. Alternatively, the functional members 36 may be released by opening a mechanical member, for instance a tab which is pulled open to release the functional members 36.

The functional members 36 may be cleaning agents such as floor wax, scrubbing agents, disinfectants, deodorants, bleach, etc. Although shown as incorporated into the mop head 16, the functional members 36 may instead be incorporated into the primary or secondary cleaning members 18, 20.

The functional members 36 may also be configured in order to act as a biosensor for indicating the presence of anthrax or other biological or chemical agents. In one such bioluminescent system, the functional members 36 include B lymphocytes that contain antibodies for the target analytes and a green fluorescent protein from jellyfish that becomes activated when the antibodies contact the target analytes.

Various types of biosensors are disclosed in U.S. patent application Ser. No. 10/277,170 filed on Oct. 21, 2002 and entitled "Healthcare Networks With Biosensors", which is assigned to the assignee of the present application. The entire contents of U.S. patent application Ser. No. 10/277,170 are incorporated by reference herein in their entirety for all purposes. The biosensor may be a fluorescent protein or a genetically engineered cell in a pathogen identification sensor that glows when the biosensor detects the presence of the particular bacterial or chemical agent. An example of a fluorescent protein may be found in U.S. Pat. No. 6,197,928 entitled "Fluorescent Protein Sensors for Detection of Analytes", which issued on Mar. 6, 2001. The entire contents of U.S. Pat. No. 6,197,928 are incorporated by reference herein in their entirety for all purposes.

In accordance with other exemplary embodiments of the present invention, the primary cleaning member 18 may be a disposable mop substitute such as that set forth in U.S. patent application Ser. No. 10/036,736 filed on Dec. 21, 2001, entitled "Sponge-like Pad Comprising Paper Layers and Method of Manufacture". U.S. patent application Ser. No. 10/036,736 is owned by the assignee of the present application and is incorporated by reference herein in its entirety for all purposes. In this instance, the primary cleaning member 18 further includes a disposable wipe 54 located on one end thereof and attached to the mop head 16.

Figure 6:
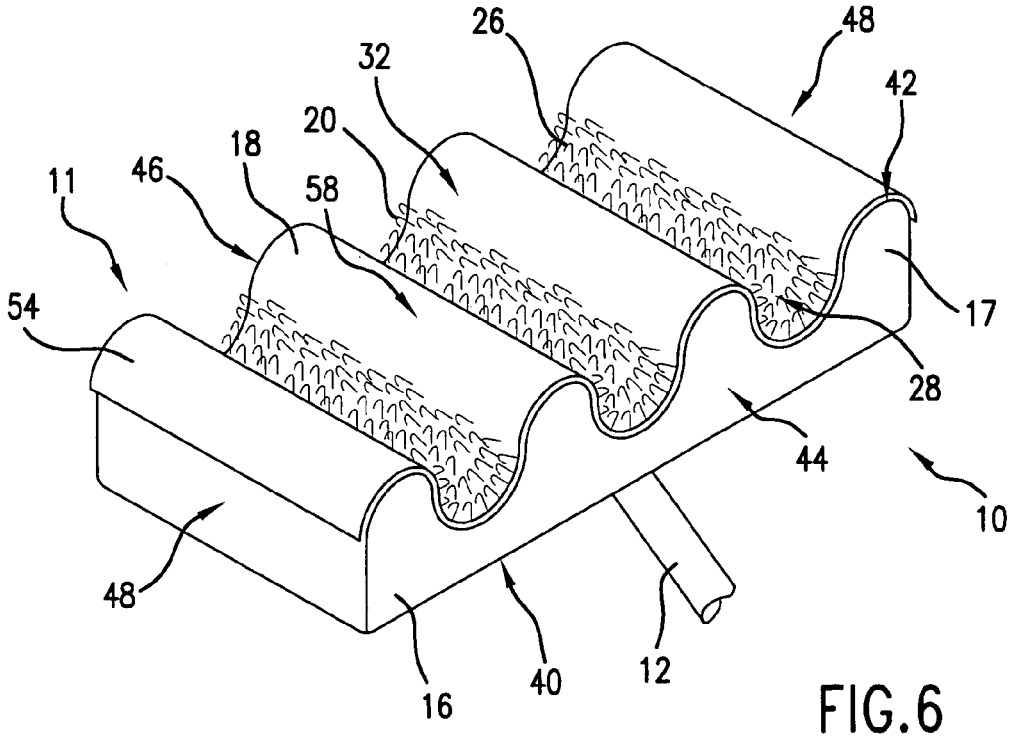
FIG. 6 is a perspective view of a mop in accordance with one exemplary embodiment of the present invention. A mop head of the mop includes a disposable wipe having a three-dimensional cleaning surface where a plurality of hooks are disposed in cavities of the disposable wipe.

The mop head 16 may be configured as shown in FIG. 6 where the primary cleaning member 18 is a disposable wipe 54 that is attached to the bottom surface of the mop head 42. The disposable wipe 54 forms a three-dimensional cleaning surface 32. The mop head 16 may be formed of a rigid material in which the bottom surface 42 is three-dimensional in shape. The disposable wipe 54 is placed over the bottom surface 42 and affixed thereto, hence causing the disposable wipe 54 to form the three-dimensional cleaning surface 32. The three-dimensional cleaning surface 32 thus forms a plurality of cavities 28 on the bottom surface 42 of the mop head 16. A secondary cleaning member 20, in this case hooks 26, are attached to the disposable wipe 54 at locations which cause the hooks 26 to be disposed in the cavities 28 of the three-dimensional cleaning surface 32.

The height of the cavity 28 may decrease (e.g., in a tapered manner or in one or more step changes) from a high value at or near a first edge of the mop head 16 to a lower value as the cavity 28 nears a second edge of the mop head 16. Regardless of whether the cavity 28 is tapered, the cavity 28 may begin and terminate in the central portion of the mop head 16 rather than at an edge of the mop head 16. In one embodiment, the cavity 28 does not extend between two edges of the mop head 16.

Figure 7:
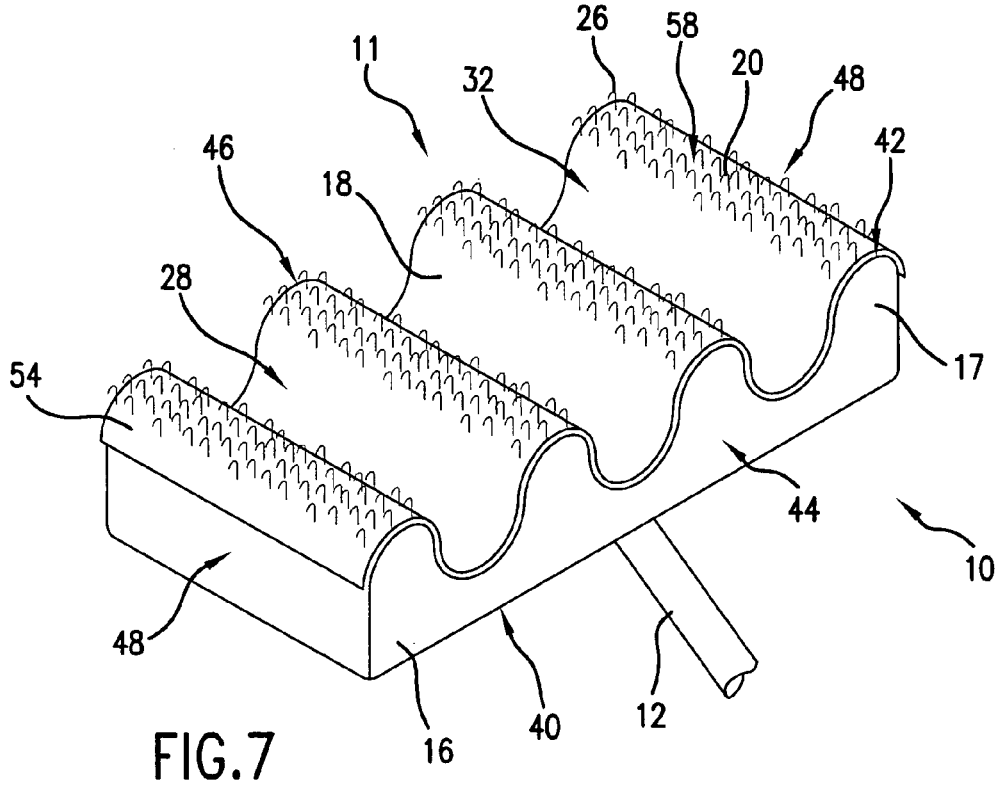
FIG. 7 is a perspective view of a mop in accordance with one exemplary embodiment of the present invention. The mop includes a mop head that has a disposable wipe having a three-dimensional cleaning surface, and a plurality of hooks on the three-dimensional cleaning surface located outside of the cavities of the three-dimensional cleaning surface.
Figure 8:
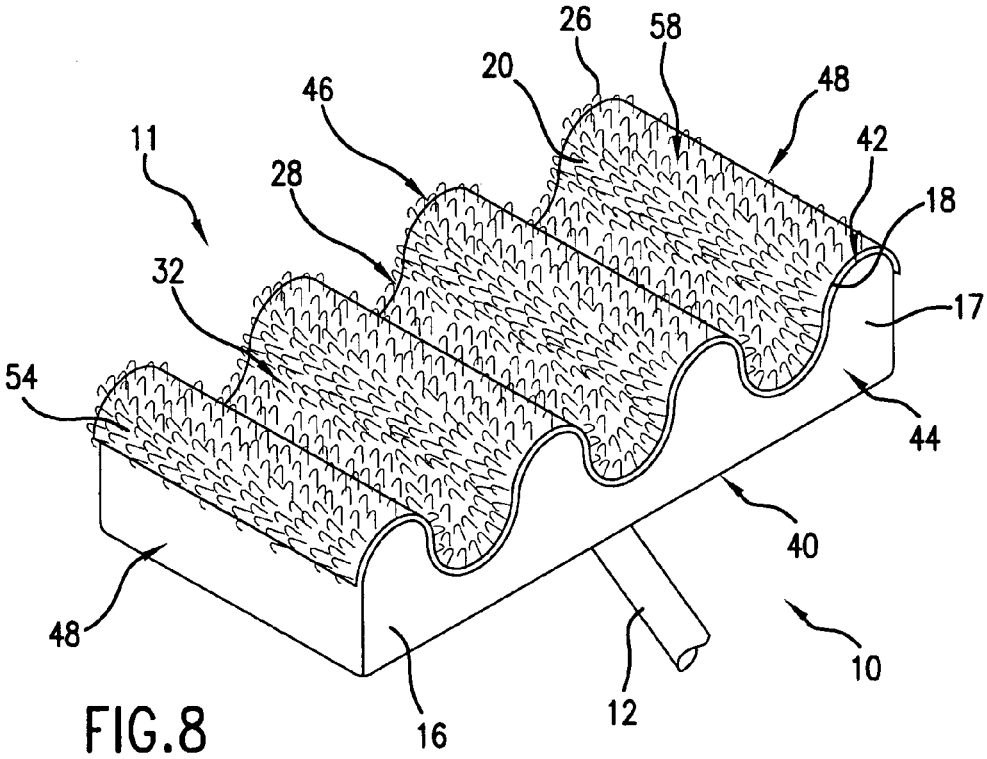
FIG. 8 is a perspective view of a mop in accordance with one exemplary embodiment of the present invention. The mop includes a mop head that has a disposable wipe that has a three-dimensional cleaning surface, and a plurality of hooks located on the three-dimensional cleaning surface both inside and outside of the cavities of the three-dimensional cleaning surface.

In alternative exemplary embodiments of the present invention, the hooks 26 may be located outside of the cavities 28. Such a configuration is shown in FIG. 7. In this instance, generally larger sized particles 22 (not shown) may be either attached to the hooks 26 or retained within the cavities 28 of the three-dimensional cleaning surface 32. Generally smaller sized particles 24 (not shown) may be retained on either the disposable wipe 54 or the hooks 26. FIG. 8 shows another alternative exemplary embodiment where the hooks 26 are located both in the cavity 28 and outside of the cavity 28. Again, particles of any size may be retained on the hooks 26 and/or disposable wipe 54.

Figure 9:
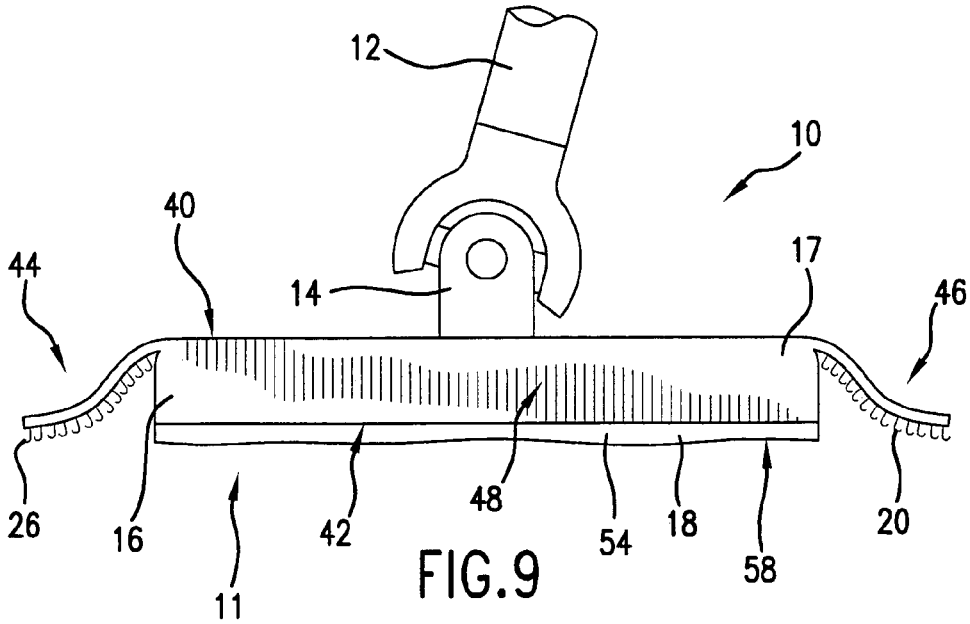
FIG. 9 is a side view of a mop in accordance with one exemplary embodiment of the present invention. The mop includes a mop head that carries both a primary cleaning member and a secondary cleaning member which is not attached to the primary cleaning member.

Although previously shown as attached to the primary cleaning member 18, the secondary cleaning member 20 may be separate from the primary cleaning member 18 in accordance with other exemplary embodiments. FIG. 9 shows one such configuration where the primary cleaning member 18 is attached to the bottom surface 42 of the mop head 16. The secondary cleaning member 20, in this instance a plurality of hooks 26, are not attached to the primary cleaning member 18 but are instead attached to the leading and trailing edges 44, 46 of the mop head 16. The secondary cleaning member 20 may be alternatively attached to either the leading or trailing edge 44, 46 alone.

Figure 10:
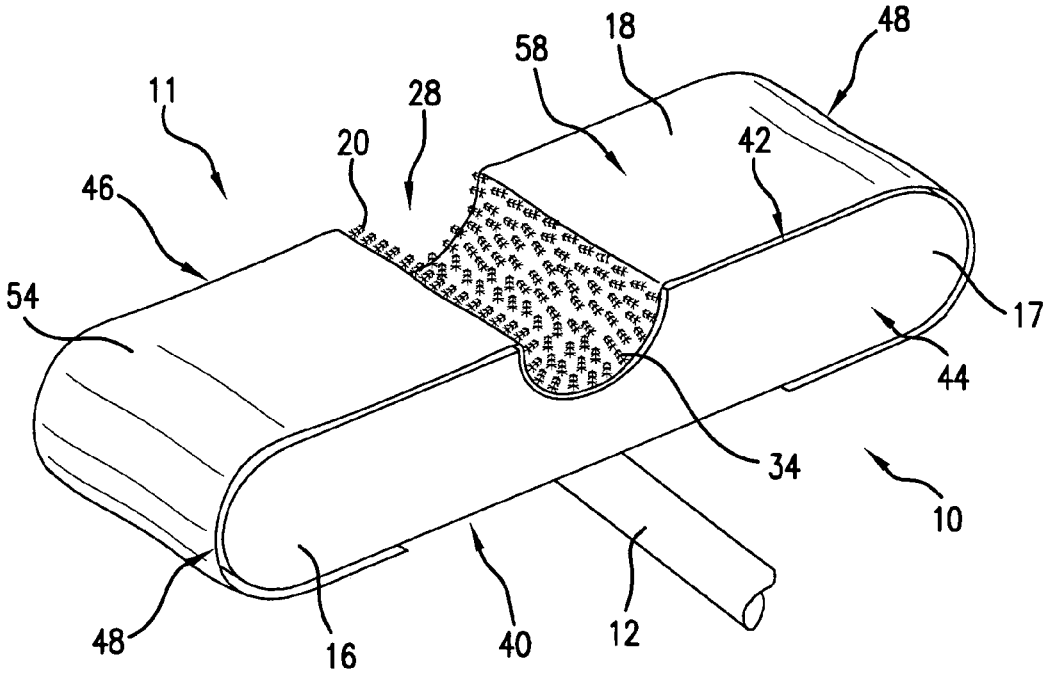
FIG. 10 is a perspective view of a mop in accordance with one exemplary embodiment of the present invention. The mop includes a mop head that defines a cavity thereon, and includes a plurality of gecko fasteners located in the cavity.

The secondary cleaning member 20 may be a member or members other than the hooks 26 disclosed in previous exemplary embodiments. For instance, FIG. 10 shows a mop 11 in which the secondary cleaning member 20 is a plurality of gecko fasteners 34. Principles of gecko adhesion are discussed in more detail by Kelly Autumn et al., "Evidence for van der Waals Adhesion in Gecko Setae," Proceedings of the National Academy of Sciences of the United States of America, Vol. 99, No. 19, pp. 12,252-12,256 (Sep. 17, 2002), and by Robert J. Full et al., "Adhesive Microstructure and Method of Forming the Same," WO 01/49776, published July 12, 2001, both of which are incorporated by reference herein in their entireties.

Figure 11:
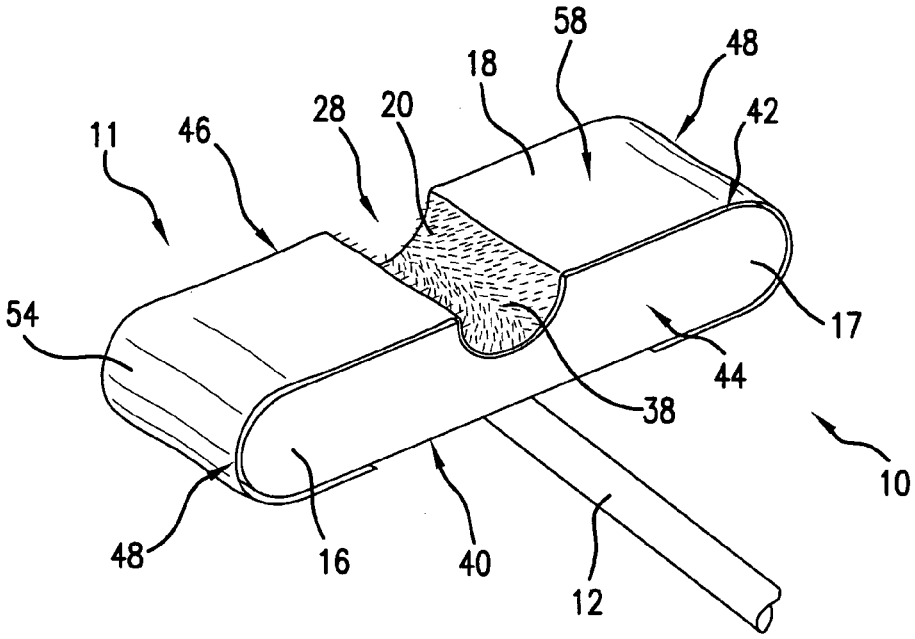
FIG. 11 is a perspective view of a mop in accordance with one exemplary embodiment of the present invention. The mop includes a mop head that defines a cavity thereon, and includes a brush located in the cavity.

Alternatively, FIG. 11 shows an exemplary embodiment in which the secondary cleaning member 20 is a brush 38. As discussed with respect to the previous exemplary embodiments, the gecko fasteners 34 and the brush 38 act to remove and retain generally larger sized particles 22 such as spider webs, dust balls, lint, etc., thereon.

Figure 12:
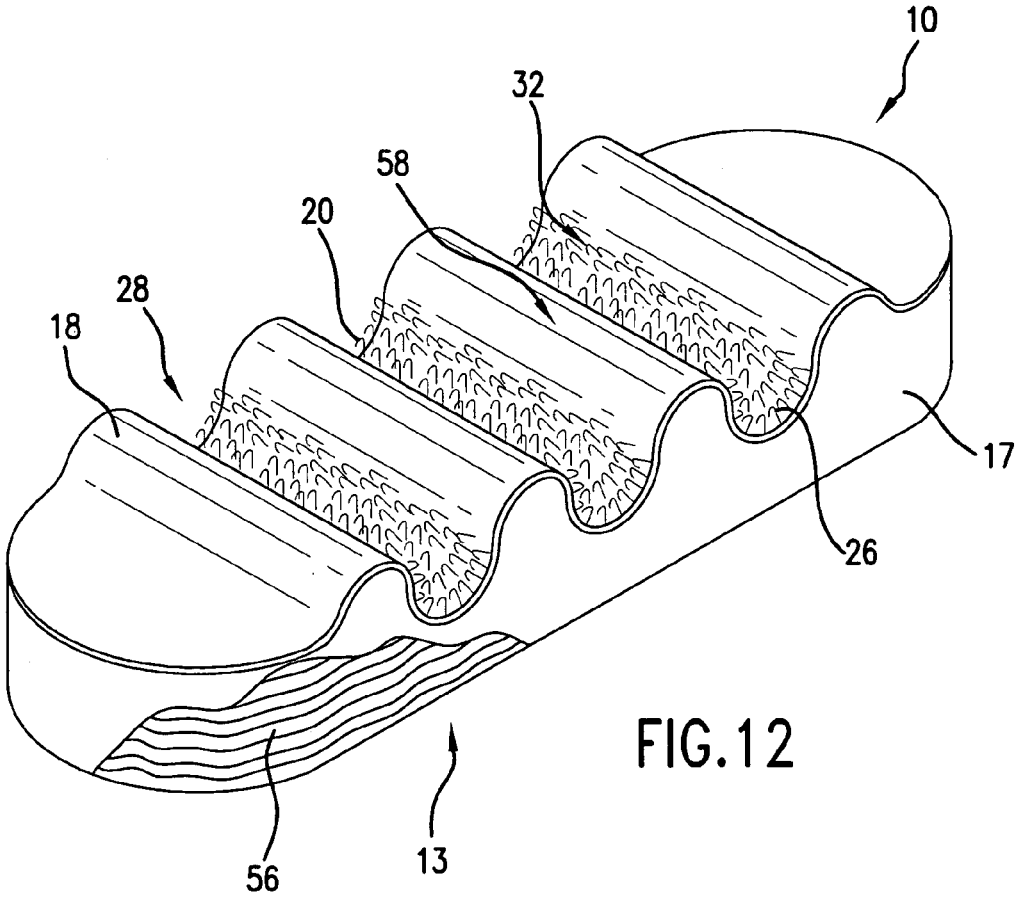
FIG. 12 is a perspective view of a hand wipe in accordance with one exemplary embodiment of the present invention. The hand wipe includes a frame with a plurality of tissue layers and a three-dimensional cleaning surface having a plurality of hooks located thereon.

The cleaning tool 10 of the present invention may be configured as a hand wipe 13 as shown in FIG. 12. Here, the frame 17 is a plurality of tissue layers 56. The tissue layers 56 may be connected to one another by binder material. The tissue layers 56 used may be configured in order to spring back into an initial shape after a user grasps and deforms the hand wipe 13 during use. Additionally, the tissue layers 56 may help to retain water within the hand wipe 13 when the hand wipe 13 is used for wet wiping.

The primary cleaning member 18 is located on an outer surface of the frame 17. The primary cleaning member 18 may simply be one or more of the tissue layers 56 of the plurality of tissue layers 56 that make up the frame 17. The primary cleaning member 18 is shaped so that a three-dimensional cleaning surface 32 is formed. The three-dimensional cleaning surface 32 defines a plurality of cavities 28 into which the secondary cleaning members 20, in this instance hooks 26, are located.

The cleaning tool 10 may be used to clean any type of surface. For example, the cleaning tool 10 may be used as a dishwashing wipe. Further, the cleaning tool 10 may be used as an exfoliation wipe or other skin cleaning tool.

The primary and secondary cleaning members 18, 20 may be made in a variety of manners in accordance with the present invention. For instance, in one method a three-dimensional nonwoven web such as a high loft bonded carded web, a rush transferred nonwoven web, a needle punched laminated web, a thermally molded fibrous web with bi-component fibers, or the like may be formed with elevated and depressed regions hence forming the cavities 28. The secondary cleaning member 20 may be a patch of hook material or other abrasive that is deposited into the cavities 28. In another method, the primary cleaning member 18 is an elastic nonwoven web such as a film or melt blown web that is stretched. The secondary cleaning members 20 are adhered to certain portions of the nonwoven web, and the nonwoven web is allowed to contract. This causes the nonwoven web to pucker upwards around the secondary cleaning members 20.

In a further method, the secondary cleaning members 20 may be placed in discreet zones on a substantially flat first web which helps form the primary cleaning member 18, and is then molded into a three-dimensional shape with the secondary cleaning members 20 lying below the plane defined by the upper regions of the first web. The depressed regions of the first web are then bonded to a second web, which forms part of the primary cleaning member 18, that is either elastic or inelastic and optionally impervious. The second web restrains the first web in a puckered shape and the secondary cleaning members 20 are located in the depressed regions.

Alternatively, the primary cleaning member 18 may be a relatively inelastic film or other nonwoven web and may be stretched and the secondary cleaning member 20 attached thereto. Next, the web is heated in order to cause the web to contract, resulting in puckered regions between the secondary cleaning members 20. The web may then be optionally attached to a second web with spot bonding joining the second web to the depressed regions of the first web of the side remote from the secondary cleaning member 20.

It should be understood that the present invention includes various modifications that can be made to the embodiments of the cleaning tool 10 as described herein as come within the scope of the appended claims and their equivalents.

What is claimed is:

1. A cleaning tool for use in cleaning a surface to be cleaned, comprising:

a frame a primary cleaning member carried by the frame and defining a main contacting surface, the primary cleaning member being configured for removing generally smaller sized particles from the surface to be cleaned, the primary cleaning member defining a leading side spaced apart from a trailing side in a lateral direction;

a secondary cleaning member carried by the frame which includes protrusions for engaging and removing generally larger sized particles from the surface to be cleaned;

at least one cavity extending upward from the main contacting surface of the primary cleaning member and extending from the leading side of the primary cleaning member to the trailing side of the primary cleaning member;

wherein the secondary cleaning member is located at least inside the cavity and is attached to the primary cleaning member;

wherein the at least one cavity occupies less than an entire leading or trailing side of the primary cleaning member; and wherein a length of either the leading and trailing sides is greater than the distance the leading and trailing sides are spaced apart in the lateral direction.

2. The cleaning tool as set forth in claim 1, wherein the secondary cleaning member is a plurality of hooks configured for engaging the generally larger sized particles and retaining the generally larger sized particles thereon.

3. The cleaning tool as set forth in claim 1, wherein the primary cleaning member defines the at least one cavity, and wherein the secondary cleaning member is located in the cavity defined by the primary cleaning member.

4. The cleaning tool as set forth in claim 1, wherein the secondary cleaning member is attached to the primary cleaning member.

5. The cleaning tool as set forth in claim 1, wherein the primary cleaning member is a disposable sponge substitute made of laminated tissue layers.

6. The cleaning tool as set forth in claim 1, wherein the primary cleaning member is a nonwoven web.

7. The cleaning tool as set forth in claim 1, wherein the primary cleaning member has a three-dimensional cleaning surface that defines the at least one cavity.

8. The cleaning tool as set forth in claim 7, wherein the secondary cleaning member is attached to the three-dimensional cleaning surface of the primary cleaning member and is located in the cavity defined by the three-dimensional cleaning surface.

9. The cleaning tool as set forth in claim 7, wherein the secondary cleaning member is attached to the three-dimensional cleaning surface of the primary cleaning member and is located both in the cavity and outside of the cavity defined by the three-dimensional cleaning surface.

10. The cleaning tool as set forth in claim 1, wherein the secondary cleaning member is a gecko fastener configured for engaging the generally larger sized particles and retaining the generally larger sized particles thereon.

11. The cleaning tool as set forth in claim 1, further comprising a biosensor carried by the frame and configured for indicating the presence of a biological or chemical agent.

12. The cleaning tool as set forth in claim 11, wherein the biosensor indicates the presence of a biological or chemical agent by an optical signal.

13. The cleaning tool as set forth in claim 1, wherein the secondary cleaning member is a brush configured for engaging the generally larger sized particles and retaining the generally larger sized particles thereon.

14. The cleaning tool as set forth in claim 1, further comprising a cleaning agent carried by the frame and configured for being activated and subsequently transferred to the surface to be cleaned.

15. A cleaning tool as set forth in claim 1 wherein the area of the at least one cavity occupies less than 50 percent of the surface area of the main contacting surface.

16. A cleaning tool as set forth in claim 1 wherein the area of the at least one cavity occupies less than 40 percent of the surface area of the main contacting surface.

17. A cleaning tool as set forth in claim 1 wherein the area of the at least one cavity occupies less than 30 percent of the surface area of the main contacting surface.

18. A cleaning tool as set forth in claim 1 wherein the area of the at least one cavity occupies less than 20 percent of the surface area of the main contacting surface.

19. A mop for use in cleaning a surface to be cleaned, comprising:

a handle configured to be grasped by a user of the mop;

a mop head attached to the handle a primary cleaning member carried by the mop head and configured for retaining unwanted objects thereon when a user operates the mop to move a main contacting surface of the primary cleaning member across the surface to be cleaned, the primary cleaning member defining a leading side spaced apart from a trailing side in a lateral direction;

a secondary cleaning member carried by the mop head wherein the secondary cleaning member includes protrusions for engaging and retaining unwanted objects thereon that escaped retention by the primary cleaning member; and at least one cavity extending upward from the main contacting surface of the primary cleaning member and extending from the leading side of the primary cleaning member to the trailing side of the primary cleaning member;

wherein the secondary cleaning member is located at least inside the cavity and is attached to the primary cleaning member wherein the at least one cavity occupies less than an entire leading or trailing side of the primary cleaning member; and wherein a length of either the leading and trailing sides is greater than the distance the leading and trailing sides are spaced apart in the lateral direction.

20. The mop as set forth in claim 19, wherein the primary cleaning member is a disposable wipe that is attached to the upper surface of the mop head and covers the bottom surface of the mop head.

21. The mop as set forth in claim 19, further comprising a cleaning agent carried by the mop head and configured for being activated and subsequently transferred to the surface to be cleaned.

22. The mop as set forth in claim 21, wherein the cleaning agent is an aqueous solution contained in a plurality of capsules in the primary cleaning member, force imparted onto the capsules cause the capsules to break and for the aqueous solution to be activated.

23. The mop as set forth in claim 19, wherein the primary cleaning member is a disposable wipe attached to the bottom surface of the mop head and free from contact with the top surface of the mop head.

24. The mop as set forth in claim 19, wherein the primary cleaning member is made of a plurality of laminated wet resilient tissue layers and has an outer layer that is made of a nonwoven material.

25. The mop as set forth in claim 24, wherein the primary cleaning member defines the at least one cavity, and wherein the secondary cleaning member is attached to the primary cleaning member and is located in the cavity defined by the primary cleaning member.

26. The mop as set forth in claim 19, wherein the secondary cleaning member is a plurality of hooks.

27. The mop as set forth in claim 19, wherein the secondary cleaning member is attached to the primary cleaning member.

28. The mop as set forth in claim 19, wherein the primary cleaning member is a non-woven web.

29. The mop as set forth in claim 19, wherein the primary cleaning member has a three-dimensional cleaning surface that defines the at least one cavity.

30. The mop as set forth in claim 29, wherein the secondary cleaning member is attached to the three-dimensional cleaning surface of the primary cleaning member and is located in the cavity defined by the three-dimensional cleaning surface.

31. The mop as set forth in claim 29, wherein the secondary cleaning member is attached to the three-dimensional cleaning surface of the primary cleaning member and is located both in the cavity and outside of the cavity defined by the three-dimensional cleaning surface.

32. The mop as set forth in claim 19, wherein the secondary cleaning member is a gecko fastener.

33. The mop as set forth in claim 19, further comprising a biosensor carried by the mop head and configured for indicating the presence of a biological or chemical agent.

34. The mop as set forth in claim 33, wherein the biosensor indicates the presence of a biological or chemical agent by an optical signal.

35. The mop as set forth in claim 19, wherein the secondary cleaning member is a brush.

36. A mop for use in cleaning a surface to be cleaned, comprising:

a handle configured to be grasped by a user of the mop;

a mop head attached to the handle;

a primary cleaning member attached to the mop head and made of a plurality of laminated wet resilient tissue layers contained in a nonwoven envelope, the primary cleaning member defines a cavity which extends from a leading side of the primary cleaning member to a trailing side of the primary cleaning member, the primary cleaning member is configured for retaining unwanted objects thereon when a user operates the mop to move the primary cleaning member across the surface to be cleaned;

wherein a length of either the leading and trailing sides is greater than the distance the leading and trailing sides are spaced apart in the lateral direction; and a plurality of hooks attached to the primary cleaning member and located in the cavity defined by the primary cleaning member, the plurality of hooks are configured for retaining unwanted objects thereon that escaped retention by the primary cleaning member.

* * * * *

UNITED STATES PATENT AND TRADEMARK OFFICE

CERTIFICATE OF CORRECTION

PATENT NO. : 7,591,040 B2
APPLICATION NO. : 10/739530
DATED : September 22, 2009
INVENTOR(S) : Jou-Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 461 days.

Signed and Sealed this

Twenty-first Day of September, 2010

David J. Kappos

David J. Kappos
*Director of the United States Patent and Trademark Office*